US007117915B2

(12) United States Patent
Rolion

(10) Patent No.: US 7,117,915 B2
(45) Date of Patent: Oct. 10, 2006

(54) HAND-HELD DEVICE FOR APPLYING A FILM OF ADHESIVE, COVERING OR COLORED MATERIAL ONTO A SUBSTRATE

(75) Inventor: Franck Rolion, Belloy en France (FR)

(73) Assignee: Societe BIC S.A., Clichy (FR)

( * ) Notice: Subject to any disclaimer, the term of this patent is extended or adjusted under 35 U.S.C. 154(b) by 52 days.

(21) Appl. No.: 10/803,463

(22) Filed: Mar. 18, 2004

(65) Prior Publication Data

US 2004/0250961 A1 Dec. 16, 2004

Related U.S. Application Data

(63) Continuation of application No. PCT/EP02/07965, filed on Jul. 17, 2002.

(30) Foreign Application Priority Data

Sep. 19, 2001 (EP) ..... 01122365

(51) Int. Cl.
*B32B 37/26* (2006.01)

(52) U.S. Cl. ..... 156/577; 156/523; 118/76; 118/257; 242/160.4; 242/171; 242/588.6

(58) Field of Classification Search ..... 156/523, 156/574, 577, 579, 547, 527, 238, 538, 540; 118/200, 257, 76; 206/411; 242/170, 171, 242/588.3, 588.2, 588.6, 588, 160.2, 160.4
See application file for complete search history.

(56) References Cited

U.S. PATENT DOCUMENTS 4,851,076 A 7/1989 Manusch et al.
4,853,074 A 8/1989 Manusch et al.
5,303,759 A 4/1994 Czech
5,714,035 A 2/1998 Stevens
5,772,840 A 6/1998 Morinaga

FOREIGN PATENT DOCUMENTS

| | | | |
|---|---|---|---|
| EP | 0 551 522 B1 | | 7/1992 |
| JP | 6 286926 | | 11/1994 |
| JP | 10181289 A | * | 7/1998 |
| JP | 2001-89011 | | 3/2001 |
| WO | WO 96/15060 | | 8/1995 |

OTHER PUBLICATIONS

International Search Report for International Application PCT/EP02/07965.

* cited by examiner

*Primary Examiner*—Mark A. Osele
(74) *Attorney, Agent, or Firm*—Jones Day

(57) ABSTRACT

The invention relates to a hand-held device for transferring a film of, for example, adhesive, covering, or colored material onto a substrate. The device has a housing accommodating a film supply and an application member longitudinally projecting from the housing. Film extends from the supply at the lower longitudinal side of the application member facing the substrate during the mode of operation to an application edge of the application member running transversely at the front end. The application member is composed of two application member portions movable relative to each other. In order to enhance the movability of the hand-held device, the relative movement is limited by motion stops provided as an integral part at the application member portions.

19 Claims, 3 Drawing Sheets

HAND-HELD DEVICE FOR APPLYING A FILM OF ADHESIVE, COVERING OR COLORED MATERIAL ONTO A SUBSTRATE

CROSS-REFERENCE TO RELATED APPLICATION

This application is a continuation of PCT Application No. PCT/EP02/07965, filed on Jul. 17, 2002, which claims priority to European Patent Application 01 122 365.8, filed on Sep. 19, 2001. The entire contents of these two applications is expressly incorporated herein by reference.

FIELD OF THE INVENTION

The present invention relates to a hand-held device for applying a film of adhesive, covering, or colored material onto a substrate, the device having an application member or tip with a movable portion.

BACKGROUND OF THE INVENTION

A hand-held device of this type is described in U.S. Pat. No. 5,772,840, corresponding to EP 0 719 723 B1. In this previously known hand-held device, a longish application member is supported to be pivotable around its longitudinal axis and is centered in the middle by spring forces with respect to pivotable movements opposing each other. Thereby, the application member can adapt to the substrate by means of rotation in case that the application member is placed on the substrate in an oblique fashion. In the absence of pressure, the application member turns automatically into its rotational central position due to the present restoring elastic force. In addition, the application member comprises in its longitudinal portion extending outside the housing of the hand-held device guiding webs protruding upwards and downwards at both sides, between which a backing tape carrying the film is guided. In front of the guiding webs, the application member has a cross-sectional reduction on both sides in the form of lateral recesses. The purpose of said cross-sectional reduction is not described.

Another hand-held with a movable application member can also be derived from U.S. Pat. No. 4,851,076, corresponding to DE 3 638 722 A. The longish application member of this patent comprises a cross-sectional reduction in the form of the body of a wasp in addition to its elastically yielding arrangement. Thereby, the front portion of the application member is elastically bendable in a transverse direction and suspended in a pendulous fashion.

What can be derived from U.S. Pat. No. 4,853,074, corresponding to EP 0 313 719 B1, is a hand-held device whose application member is movable upwards from a lower starting position against an elastic spring force against a stop at the housing. Thereby, the application member is resilient to the top by the pressure effective in this case when the application member is placed onto the substrate, and it is spring-mounted against sudden overload.

SUMMARY OF THE INVENTION

The present invention improves a hand-held device of the type described above with respect to how its movement is carried out and/or to design a handheld device such that it can be manufactured easily and inexpensively. In doing so, a small construction is supposed to be ensured as well. Moreover, the arrangement and mounting of the application member in the housing is supposed to be improved and/or simplified.

In a hand-held device formed in accordance with principles of the present invention, stops acting together are provided at the front and rear portions of the application member. The stops border the relative movement of the front portion during the mode of operation. Thereby, several advantages are achieved. For one, the application member is stabilized by the stops, since the bending stress is reduced when the stop is reached. This is due to the fact that, when the stop is reached, the stops arranged at a, for instance, transverse distance from the center of the bending range of the application member reduce the moments of force effective in the bending range. This can be explained such that bending stresses are effective in the bending range before the stop is reached, while it is primarily tensile stresses that are effective in the bending range when the stop has been reached. Due to the distance of the stops from the center of the bending range, there are reduced stresses in the bending range when the stop has been reached because of the lever principle. In addition, it is possible to manufacture parts of simple and small construction in the configuration according to the invention. This is due to the fact that the invention provides for both stops to be arranged at the application member, so that they can be mounted more easily and in particular as an integral part when manufacturing the application member. As a result thereof, special costs for the manufacture of the stops are not incurred.

It is possible within the framework of the invention to use the stops for limiting a bending movement and/or torsion movement of the front portion. In the former case, the stops are at an axial distance from each other directed towards the longitudinal direction of the application member in the ordinary original position of the front portion. In the latter case, said distance is directed towards the peripheral direction, so that the front portion can carry out a pivotable or torsional movement.

The restoring elastic force is generated by the fact that the application member is composed of an elastically deformable material at least in its bending and/or torsion range. As a result thereof, the elastic restoring force is generated during movement against the stops and is stored in the material, so that it moves the front portion back into its neutral original position after said front portion has been relieved.

Within the framework of the invention, the bending and/or torsion range between the rear and the front portions can be localized by a cross-sectional reduction, which can be provided at the upper side of the application member and/or on both sides or on all sides. By a reduction in cross-section, the bending or torsion moment of resistance in the range of deformation can, for one, be reduced and, for the other, be determined.

It is advantageous to provide the stops in the portion of the application member that extends beyond the housing, not only for reasons of construction, but also for reasons of function. In this case, it is not only that the stops have a larger space available, wherein the housing can be designed to be small and easy-to-use, but there is also a smaller distance between the front end of the application member and the stops during the mode of operation. One result thereof is not only a reduction of the stresses in the application member produced by the movement of the front portion, but the dimension of movement resulting from a movement at the front end of the front portion is desirably small.

When upper and/or lower lateral guiding webs for a backing tape are present, it is particularly advantageous to provide the cross-sectional reduction in the area of the guiding webs. In this case, the guiding web portions can form the stops, without special stops having to be created. In a preferred embodiment, stops are mounted at the application member on top and on the sides, preferably in combination with a cross-sectional reduction. The cross-sectional reductions can be constituted by thin slots, for instance of a width of less than about 2 mm or especially of less than about 1 mm. In this embodiment, the transverse bending movement is small or negligible. The stops form support surfaces for a rotational movement, which favour the torsion movement.

BRIEF DESCRIPTION OF THE DRAWINGS

In the following, preferred configurations of several exemplary embodiments shall be explained in more detail with the aid of drawings.

DETAILED DESCRIPTION OF THE INVENTION

Figure 1:
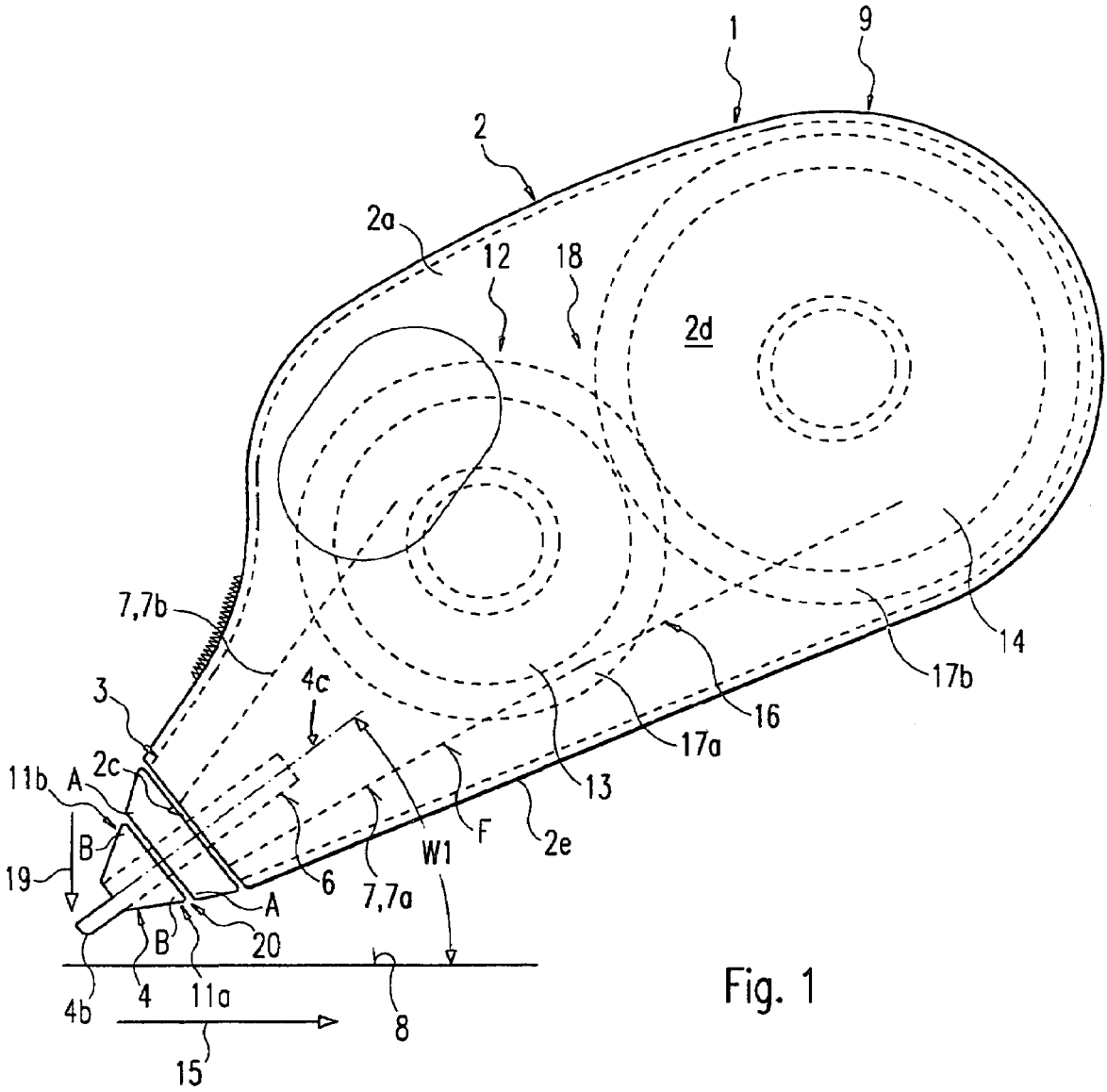
FIG. 1 is a side elevational view of an exemplary hand-held device according to the principles of the invention for transferring and/or applying a film of, for example, adhesive, covering or coloured material from a backing tape onto a substrate.

The hand-held device 1, illustrated in FIG. 1, comprises a housing 2 of convenient size, which is formed of two longitudinally or transversely divided housing parts 2*a*, 2*b* which can be mounted to each other in a detachable or non-detachable fashion. FIG. 1 shows the hand-held device 1 in its position of operation. The left-hand and lower end of the housing 2 or the hand-held device 1 in FIG. 1 is its working end 3 at which an application member 4 is provided, which projects from the circumference of the housing 2 with an application gib 4*a*. The application gib 4*a*, extends in a wedge-shaped convergent fashion towards an application edge 4*b*, which can be rounded, if necessary. The application member 4 is associated with an application base 6, the application base 6 being mounted to the housing 2 in a detachable fashion in the exemplary embodiment.

Figure 4:
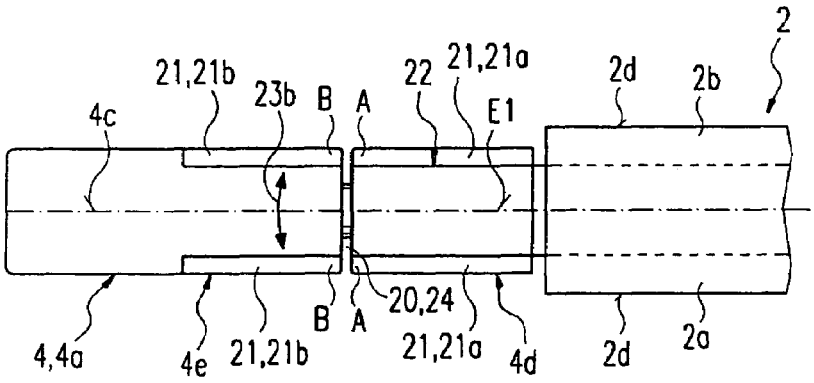
FIG. 4 is a top elevational view of a modified embodiment of an application member of the hand-held device.

The hand-held device 1 serves for transferring a film F of covering and/or colored and/or adhesive material from a film-like backing tape 7 onto a substrate 8, for instance, a sheet of paper. The backing tape 7 extends from a supply located in the cavity of the housing 2 towards the application member 4 in the area of at least one housing aperture 2*c*, is wound around its application edge 4*b*, and is refed to the cavity of the housing 2 through the housing aperture 2*c*. The winding plane is referred to by E1 (see FIG. 4). The backing tape section approaching the application gib 4*a* at the here lower longitudinal or approach side 1*la* of the application member 4 is identified by 7*a*. The backing tape section being refed into the housing 2 at the upper longitudinal or return side 11*b* of the application member 4 is identified by 7*b*. The winding plane E1 extends roughly parallel and preferably mid-centrally to the broad sides 2*d* of the housing 2, which extend, for instance, parallel to each other, the peripheral surface of the narrow side of the housing 2 being identified by 2*e*. The returning backing tape portion 7*b* extends towards a take-up device 12 mounted in the cavity of the housing 2, wherein the take-up device 12 can be a take-up spool 13 which is rotatably mounted in the housing 2. The supply 9, too, can be formed by a spool, namely a supply spool 14 which is rotatably mounted in the housing 2. In the exemplary embodiment, the supply 9 and the take-up device 12 are arranged behind each other, the take-up device 12 being disposed between the supply 9 and the working end 3 of the housing 2.

In the position of operation according to FIG. 1, the application member 4 abuts on the substrate 8 with its application edge 4*h*, wherein the central axis 4*c* of the application gib 4*d* encloses an acute angle W1 with the substrate 8 extending, for instance, to be straight, said angle ranging, for example, between approximately 30° to 60°. By moving the hand-held device 1 in the application direction identified by 15, the backing tape section 7*a* is peeled off the supply 9 due to the friction at the substrate 8. In doing so, the film F remains on the substrate surface, and the backing tape section 7*b* is moved into the cavity of the housing 2, here to the take-up device 12. The backing tape section 7*b* is driven by the backing tape section 7*a* approaching the application member 4 or its tensile force. In the present exemplary embodiment, this is effected by providing a swivel drive connection 16 between the supply spool 14 and the take-up spool 13, for instance in the form of overlapping rubbing surfaces 17*a*, 17*b* at the peripheral edges of the walls of the spools. The winding diameter of the spools 13, 14 is dimensioned to be large enough for the take-up spool 13 to attempt to pull in the backing tape 7, also in the event of a full supply spool 14, at a speed which is higher than the speed at which the backing tape 7 is wound off the supply spool 14. By a slip friction clutch 18 integrated in the swivel drive connection 16, which here is formed by the rubbing surfaces 17*a*, 17*b* which are in frictional contact with each other, it is ensured that the take-up spool 13 pulls in the backing tape 7 always at a certain tensile stress, whereby the formation of loops in the backing tape 7 is avoided. The application movement 15 is directed to the end of the housing 2 opposite the working end 3.

In the exemplary embodiment, the application gib 4*a* has a flat cross-sectional shape whose width a is a multiple of its thickness b, e.g., at a ratio of about 3:1 to 10:1, in particular about 6:1. Due to this cross-sectional shape, the application gib 4*a* has a relatively high horizontal moment of resistance and a relatively low vertical moment of resistance. As a result thereof, the application gib 4*a* tends to evade from the pressure force 19 arising during the mode of operation by bending upwards. In order to prevent this and to give guidance to the backing tape 7, lateral guiding webs 21 are provided at least on top of, preferably also at the bottom of, the application gib 4*a*, between which guiding webs the backing tape 7 is guided with freedom of play and which thus constitute a tape guidance 22. The guiding webs 21 can extend up to the front end of the application gib 4*a*. In the exemplary embodiment, the guiding webs 21 terminate towards the front at a distance c from the front end of the application gib 4*a* or its application edge 4*b*. As far as the back is concerned, the guiding webs 21 extend up to the vicinity of the housing 2, which ends in a plane end surface 2*e* at the working end 3 in the area of the housing aperture 2*c*. The rear surfaces 21*a* of the guiding webs 21 extend approximately parallel and at a small distance to the end surface 2*e*. In the area of the distance c, at which the application gib 4*a* extends beyond the guiding webs 21 to the front, the application gib 4*a* is elastically bendable in a vertical direction under the effect of the pressure force 19, and it is automatically bent back by the elastic restoring force generated when it is bent outwards, as soon as the pressure force 19 is ineffective. Thus, the application gib 4*a* is cushioned against hard pressure loads in its vertical plane.

In order to ensure that the application gib 4*a* has the degrees of freedom 23*a* to 23*d* illustrated by double arrows in the figures, the application gib 4*a* has a cross-sectional reduction 20 in the form of a slot 24 or a gap extending at right angles to the central axis 4*c*. The slot 24 reduces the cross-sectional size of the application gib 4*a* to a preferably mid-centrally arranged remaining cross-section 25 and thus diminishes the strength of the application gib 4*a* such that the portion 4*e*, which is in front with respect to the cross-sectional reduction, can carry out movements relative to the rear portion 4*d*.

In the area of the cross-sectional reduction 20, the moment of resistance of the application gib 4*a* is reduced, whereby, due to the elasticity of the material of the application gib 4*a* prevailing in the area of the remaining cross-section 25, the front gib portion 4*e* is movable relative to the rear gib portion 4*d* from its normal rest position and automatically returns into its original position due to the elasticity of material in the range of the remaining cross-section 25 after relief. A cross-sectional reduction 20 on top and/or at the bottom affords swivelling of the front gib portion 4*e* relative to the rear gib portion 4*d* in a vertical direction. This first degree of freedom is identified by 23*a*. If the cross-sectional reduction 20 is at one or on both sides of the application gib 4*a*, the front gib portion 4*e* is laterally bendable with respect to the rear gib portion 4*d* in a horizontal direction against the prevailing elastic restoring force, as identified by 23*b*. If the material reduction 20 is present on all sides, the front gib portion 4*e* is pivotable relative to the rear gib portion 4*d* both vertically and horizontally and is also torsional about the central axis 4*c* or the remaining cross-section 25, namely also against the elastic restoring force of the remaining cross-section 25, so that, in the absence of a load causing the torsion, the front gib portion 4*e* is automatically returned into its mid-central original position. Due to this elastic suspension of the front gib portion 4*e*, the latter is in a position, during the mode of operation of the hand-held device, to adapt to different lateral inclinations of the substrate surface, without the person using the device having to pay special attention to the different inclinations. Thereby, it is not only the pressure of the front gib portion 4*e* against the substrate, especially its pressure over the surface, that is improved or a pressure over the surface is ensured also in the event of different inclinations of the substrate surface, but also the handling of the hand-held device during the mode of operation is facilitated. The horizontal degree of freedom is identified by 23*b*, and the degree of torsion freedom by 23*c*.

There are at least two stops A, B corresponding with each other that are provided for bordering at least one degree of freedom. The stops are associated each with one of the two gib portions 4*d*, 4*e* and are integrally formed therewith. Depending on the direction of movement in which degree of freedom is supposed to be bordered by one pair of stops A, B, the latter are to be mounted. In order to border all degrees of freedom by pairs of stops A, B, one pair of stops A, B is required in the upper area of the gib portions 4*d*, 4*e* for bordering an upward movement, one pair of stops A, B is required in the lower area of the gib portions 4*d*, 4*e* for bordering a downward movement, one pair of stops A, B is required in each lateral area of the gib portions 4*d*, 4*e* for bordering the appertaining lateral movement, and one pair of stops A, B is required for bordering a torsion movement 23*c*.

The dimension of the movement of the degree of freedom depends on the axial distance d of the stops A, B from each other. Thus, the respective movement of the degree of freedom can be specifically dimensioned and limited by the stops A, B. The smaller the axial distance of the stops A, B from each other, the more the stops A, B constitute sliding surfaces for a rotational or torsion joint pivotable about the remaining cross-section 25, with the front gib portion 4*e* being supported so as to slide at the rear gib portion 4*d*, whereby not only the torsion movement in a plane of movement running at right angles to the central axis 4*c* is defined, but also the torsion movement is specifically guided on account of the guidance at the rear gib portion 4*d*.

The axial width of the cross-sectional reduction 20 or the axial distance d between the stops A, B in the neutral rest position of the front gib portion 4*e* can be 2 mm or less or also only 1 mm or less for a pitch and/or lateral movement of the front gib portion 4*e*, depending on the movement required. In the event that only a torsion movement is desired, the axial distance d can correspond to a sliding clearance only and be, e.g., only, a few tenths of a millimeter.

Figure 3:
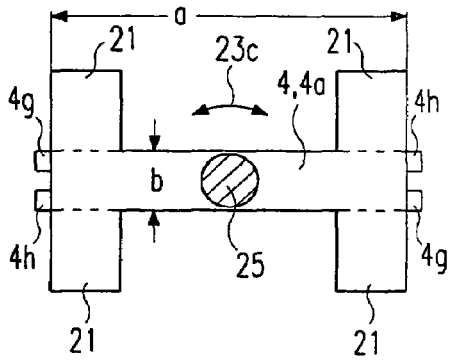
FIG. 3 is a cross-sectional view cut along line III—III of FIG. 2.

In the exemplary embodiment, the cross-sectional reduction 20 extends preferably in the mid-central longitudinal area transversely through the guiding webs 21, so that their guiding web portions 21*a*, 21*b* facing each other constitute support surface 24*a*, 24*b* representing the stops A, B. The cross-sectional reduction 20 extends preferably also in the area of the application gib 4*a*, so that the remaining cross-section 25 has a cross-sectional surface which is smaller than the cross-sectional surface of the application gib 4*a*. The cross-sectional shape of the remaining cross-section 25 can be e.g., round, as shown in FIG. 3. The vertical dimension of the remaining cross-section 25 can correspond to the vertical dimension of the application gib 4*a*.

In the exemplary embodiment, the stops A, B are thus mounted at support parts, here at the guiding webs 21, which protrude transversely from the application gib 4*a*. Leverage lengths e result therefrom, so that a load having the effect of tensile stress is exerted on the remaining cross-section 25 in a vertically or horizontally directed end position of movement and under continued bending stress in the area of the remaining cross-section 25.

Figure 2:
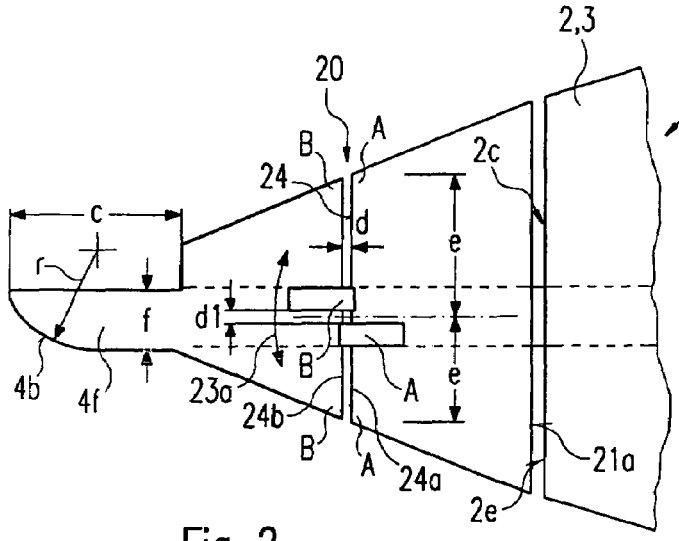
FIG. 2 is an enlarged representation of the front end portion of the hand-held device of FIG. 1.

In FIGS. 2 and 3, stops A, B, limiting a torsion movement 23*c*, are formed at material lugs 4*g*, 4*h*, respectively, at the side walls of the rear and front gib portions 4*d*, 4*e*, respectively, legs 4*g*, 4*h* extend beyond the support surfaces 24*a*, 24*b* and overlap each other at the distance d1 directed towards the peripheral direction. The angle of torsion can be, e.g., approximately +/−5°, from the stress-relieved central position.

In the exemplary embodiments according to FIGS. 5 to 7, in which identical parts are referred to by identical reference numbers, an anchoring device of how the application member 4 is anchored in the housing 2 is represented, which will be briefly described in the following.

Figure 5:
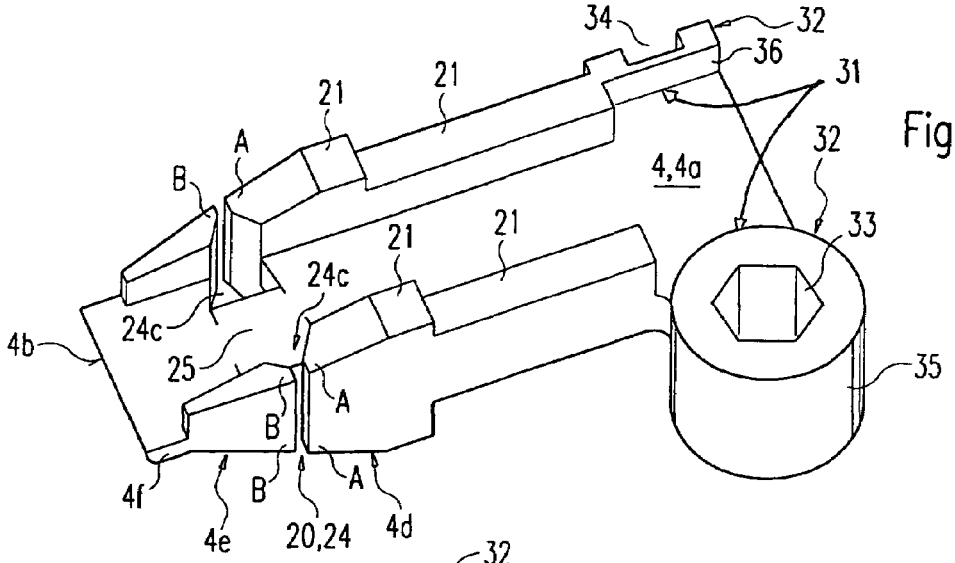
FIG. 5 is a perspective side view of a further modified embodiment of an application member.
Figure 6:
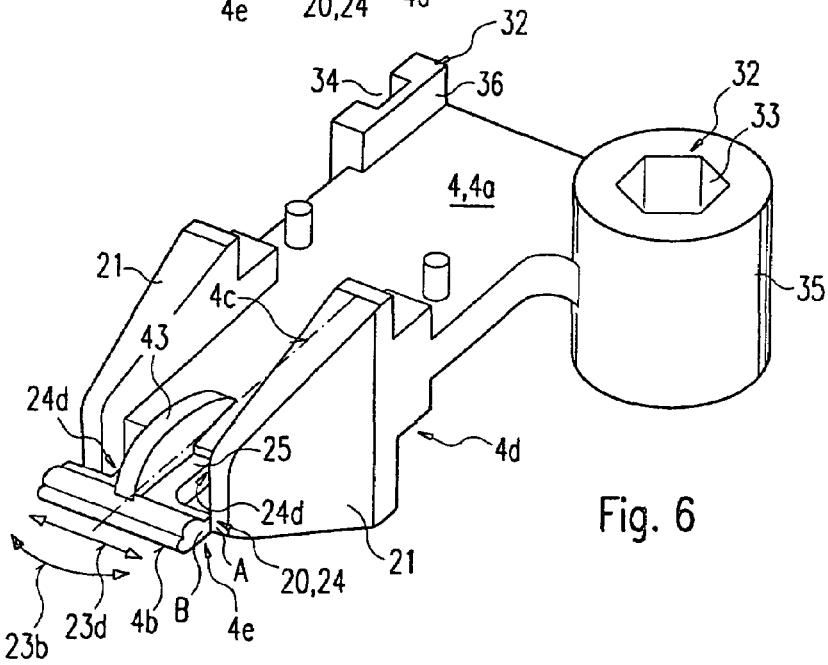
FIG. 6 is a perspective side view of a further modified embodiment of an application member.
Figure 7:
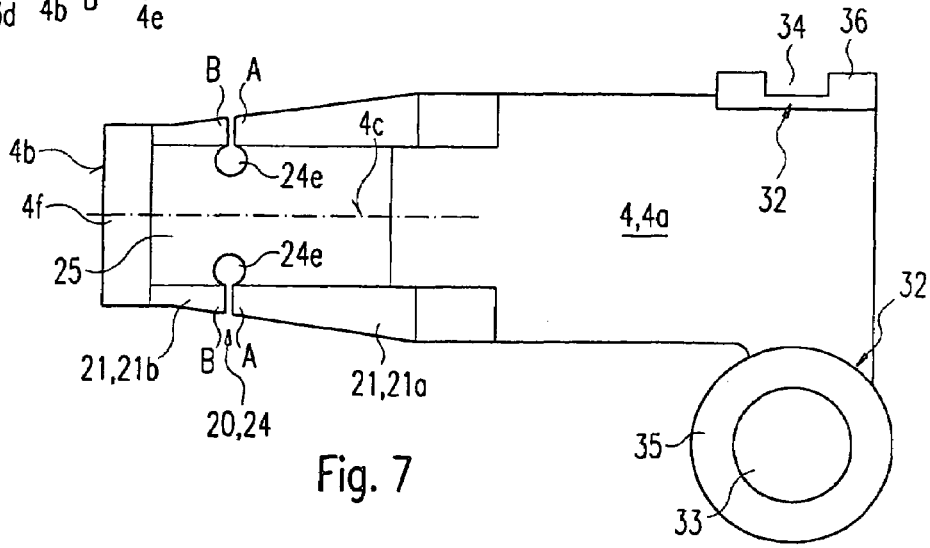
FIG. 7 is a top elevational view of a further modified embodiment of an application member.

In the exemplary, embodiments according to FIGS. 5 to 7, the respective application member 4 is designed so as to be suitable for a hand-held device in which the planes of rotation of the take-up spool 13 and the supply spool 14 run parallel to the application edge 4*b*. That is to say that in the exemplary embodiments, or FIGS. 5 to 7, the application member 4 with its application edge 4*b* is arranged to be distorted by 90° with respect to the central axis 4*c*. This is true also for the anchoring device 31. Such a type of construction of a present hand-held device is described, for instance, in EP 0 551 522 BI. In order to avoid repetitions, full reference is made to the description and the drawings of said printed publication.

In the exemplary embodiment according to FIG. 5, the guiding webs 21 are, e.g., slightly tapered, extended, towards the interior, so that they extend into the housing 2. The cross-sectional shape of the remaining cross-section 25 is designed to be longish in the horizontal direction, whereby the vertical dimension of the remaining cross-section 25 can correspond to the thickness of the application gib 4*a*. The lateral convex rounded form of the remaining cross-section 25 has proved to be an advantage and has been maintained in comparison with the remaining cross-section 25 according to FIG. 3.

It is a further difference over the configuration according to FIGS. 1 to 4 that the cross-sectional reduction or the slot 24 starting at a distance from the outer lateral surfaces of the guiding webs 21 are formed divergently to the interior. Thereby, free spaces 24*c* have been created, which simplify, among, other things, the removing of the application member 4 preferably formed as a die-cast part from the mould.

In the exemplary embodiment according to FIGS. 1 to 4 and in the exemplary embodiment according to FIG. 5, the respective front end portion of the application gib 4*a* is formed as elastically bendable applicator lip 4*f*, whose strength is dimensioned to be large enough to be elastically bendable outwards under the pressure to be exerted on the substrate 8 manually under normal conditions of usage. In the exemplary embodiment, the thickness f of the applicator lip 4*f* is dimensioned to be smaller than the thickness of the application gib 4*a*, whereby it is preferably offset towards the bottom and is tapered with respect to the application gib 4*a* by a recess on top. As is revealed particularly by FIG. 2, the application edge 4*d* can be formed by a preferably partially cylindrically rounded portion whose radius r conforms approximately to the thickness f of the applicator lip 4*f* or can be larger, as shown in FIG. 2. In the exemplary embodiment, the applicator lip 4*f* extends in the area of length c, so that it projects from the front end of the guiding webs 21.

The anchoring device 31 is formed by a form-fit effective plug-in socket 32 with at least one plug-in recess 33, by which the application member 4 can be plugged onto at least one plug-in pin at the appertaining part of the housing transversely to the plane of the application edge 4*d*. In the exemplary embodiment, two lateral plug-in recesses 33, 34 are formed at the application member 4*a* or lateral material lugs 35, 36. The one plug-in recess 33 is formed by a plug-in hole in a formed jack in the exemplary embodiment. The other plug-in recess 34 is formed by a laterally open groove in the appertaining material lug 36. The latter is positioned between two housing halves in a form-fit fashion in a direction transversely to the longitudinal plane of the application member 4 containing the application edge 4*b*.

In the exemplary embodiment according to FIG. 6, the cross-sectional reduction 20 or two lateral slots 24 also extend transversely to the central axis 4*c*, whereby they extend backwards in an angular fashion on both sides of the remaining cross-section 25. As a result thereof, free spaces 24*d* are available between the remaining cross-section 25 and the guiding webs 21, which improve the flexibility of the front gib portion 4*e* in a lateral direction. This additional degree of freedom is identified by 23*d*. Even in this embodiment, the cross-sectional reduction 20 can be formed by a relatively thin slot 24, which extends in an angular fashion on both sides of the remaining cross-section 25, as seen in a top view.

The cross-sectional reduction 20 can also extend at the front end of the guiding webs 21, as shown in FIG. 6. It can be favorable to a stabilization of the front gib portion 4*e* to reinforce the latter by a transversely extending bead 42, which is preferably provided on top. For further reinforcement, the remaining cross-section 25 can be stabilized between the free spaces 24*d* by a longitudinal web 43 on top, which preferably turns into the bead 42. For further stabilization, the guiding webs 21 can be designed to be divergent towards the back, in particular divergent in a wedge-shaped fashion.

The latter is provided for also in the exemplary embodiment according to FIG. 7. In addition, said configuration differs from FIG. 5 in that the cross-sectional reduction 20 or two lateral slots 24 directed towards each other terminate inside into preferably round slot extensions 24*e*.

The housing 2 or the housing parts 2*a*, 2*b*, the reels 12, 13, and the application member 4 are preferably injection molded parts, especially made of plastic material, which ensure simple and inexpensive manufacture also in case of complicated shapes.

The invention claimed is:

1. A hand-held device for transferring a film onto a substrate, said hand-held device comprising:

a housing configured for accommodating a film supply; and an application member projecting from said housing along a longitudinal axis;

wherein said application member has at least two application member portions movable relative to each other wherein motion stops corresponding with each other are arranged at said movable application member portions, said stops bordering the relative movement between said movable application member portions, wherein a cross-sectional reduction is provided between said movable application member portions, wherein said movable application member portions are formed by flat gibs placed one behind the other, and wherein at least one of the motion stops are formed by lateral webs guiding the film.

2. A hand-held device as claimed in claim 1, wherein said motion stops include at least one pair of stops provided at an axial distance from each other.

3. A hand-held device as claimed in claim 1, wherein said motion stops include at least one pair of stops provided directed towards the peripheral direction and at a distance from each other perpendicular to said longitudinal axis.

4. A hand-held device as claimed in claim 1, wherein said application member has an upper side, a bottom side, and side surfaces; and at least one pair of stops is provided at at least one of said upper side, said bottom side, or said side surfaces of said application member.

5. A hand-held device as claimed in claim 1, wherein said cross-sectional reduction is constituted by a gap.

6. A hand-held device as claimed in claim 5, wherein said gap has an axial width less than 2 mm.

7. A hand-held device as claimed in claim 6, wherein said gap has an axial width less than about 1 mm.

8. A hand-held device as claimed in claim 1, wherein said application member has a remaining cross-section at a coaxial position relative to said cross-sectional reduction.

9. A hand-held device as claimed in claim 1, further comprising lateral webs protruding upwards and/or downwards from both sides of the said flat gibs.

10. A hand-held device as claimed in claim 9, wherein said cross-sectional reduction is provided in said lateral webs.

11. A hand-held device as claimed in claim 10, wherein said cross-sectional reduction also extends into a cross-sectional portion of said application member.

12. A hand-held device as claimed in claim 11, wherein said cross-sectional reduction extends into the sides of said application member.

13. A hand-held device as claimed in claim 10, wherein said stops are formed by at least one of upper border, lower borders, or lateral borders of said lateral webs.

14. A hand-held device as claimed in claim 9, wherein said stops are formed by at least one of upper border, lower borders, or lateral borders of said lateral webs.

15. A hand-held device as claimed in claim 1, wherein:

said application member is formed by an application gib; and said movable application member portions are resiliently bendable and/or torsional relative to each other.

16. A hand-held device for transferring a film onto a substrate, said hand-held device comprising:

a housing configured for accommodating a film supply; and an application member projecting from said housing along a longitudinal axis;

wherein:

said application member has at least two application member portions movable relative to each other; and motion stops corresponding with each other are arranged at said movable application member portions, said stops bordering the relative movement between said movable application member portions, wherein said movable application member portions are formed by flat gibs placed one behind the other, further comprising lateral webs protruding upwards and/or downwards from both sides of the said flat gibs, and wherein a cross-sectional reduction is provided in said lateral webs.

17. A hand-held device as claimed in claim 16, wherein said cross-sectional reduction also extends into a cross-sectional portion of said application member.

18. A hand-held device as claimed in claim 16, wherein said stops are formed by at least one of upper border, lower borders, or lateral borders of said lateral webs.

19. A hand-held device for transferring a film onto a substrate, said hand-held device comprising:

a housing configured for accommodating a film supply; and an application member projecting from said housing along a longitudinal axis, wherein said application member has at least two application member portions movable relative to each other, wherein motion stops corresponding with each other are arranged at said movable application member portions, said stops bordering the relative movement between said movable application member portions, wherein a cross-sectional reduction is provided between said movable application member portions, wherein said movable application member portions are formed by flat gibs placed one behind the other, wherein lateral webs protrude upwards and/or downwards from both sides of the said gibs, and wherein said cross-sectional reduction is provided in said lateral webs.

* * * * *